United States Patent [19]

Makara

[11] 4,349,235

[45] Sep. 14, 1982

[54] CATHODE-RAY TUBE SOCKET SUBSTRATE

[75] Inventor: Satoshi Makara, Fukui, Japan

[73] Assignee: Murata Manufacturing Co., Ltd., Japan

[21] Appl. No.: 178,684

[22] Filed: Aug. 15, 1980

[30] Foreign Application Priority Data

Aug. 23, 1979 [JP] Japan ..... 54-116479[U]
Sep. 3, 1979 [JP] Japan ..... 54-122346[U]

[51] Int. Cl.[3] ..... H01R 13/652

[52] U.S. Cl. ..... 339/14 T; 339/17 D; 339/111; 339/193 R

[58] Field of Search ..... 339/14 T, 17 D, 111, 339/144 T, 145 T, 192 T, 193, 194

[56] References Cited

U.S. PATENT DOCUMENTS 3,716,819 2/1973 Borth ..... 339/193 R
3,818,278 6/1974 Adler ..... 339/193 R
3,867,671 2/1975 Johnson ..... 339/111
4,253,717 3/1981 Stewart ..... 339/14 T

FOREIGN PATENT DOCUMENTS 855406 11/1960 United Kingdom ..... 339/193 P
905976 9/1962 United Kingdom ..... 339/14 T

*Primary Examiner*—John McQuade
*Attorney, Agent, or Firm*—Ostrolenk, Faber, Gerb & Soffen

[57] ABSTRACT

A cathode-ray tube socket substrate for use with a cathode-ray tube of a cathode-ray tube display unit such as a television receiving set comprising a cathode-ray tube socket mounted on an insulation substrate with its pin terminals securely connected to electrodes provided thereon. On the insulation substrate there are provided discharge electrodes in opposition to each other between the terminal electrodes and earth electrode, recesses for discharge gaps being provided between the discharge electrodes respectively, said recesses being covered by a sheathing member, the discharge means being integrally composed with compactness thereby enabling to miniaturize the whole socket substrate, stabilize the discharge action, and reduce the spark noises.

5 Claims, 7 Drawing Figures

CATHODE-RAY TUBE SOCKET SUBSTRATE

The invention relates to a cathode-ray tube socket substrate for use with a cathode-ray tube of a cathode-ray tube display unit such as a television receiving set.

Since a relatively high voltage is impressed on the anode of the cathode-ray tube, spark discharge is prone to be generated between the anode and other electrodes in the cathode-ray tube by impurities which have been permitted to get into the cathode-ray tube during the production thereof. The spark discharge frequently damages the coating of the cathode in the cathode-ray tube or destroy peripheral electronic circuit parts, particularly transistors. Measures are usually taken, therefore, to induce said discharge on the outside of the cathode-ray tube.

Conventionally, various means were taken for this purpose. For example, a discharge element as a discrete part consisting of a pair of lead wires opposed to each other with a predetermined space interposed therebetween was disposed between the socket terminal for receiving the pin terminal of the cathode-ray tube and the earth; a cathode-ray tube socket provided with an internal discharge unit was used; or a through hole for discharge was provided on the insulation substrate on which the cathode-ray tube socket was mounted, discharge electrodes being disposed on both sides of said through hole.

However, when discharge elements are used as discrete parts, 5–7 elements are usually necessitated. This requires a relatively large space making it difficult to reduce the cathode-ray tube socket substrate in size. Moreover, the procedure requires a time-consuming operation.

In addition, a cathode-ray tube socket provided with a discharge unit has a complicated internal construction. Thus the socket is not only priced higher but also larger-sized thereby making it very difficult to miniaturize the substrate on which the socket is to be mounted. Furthermore, when through holes are provided on the cathode-ray tube socket substrate, dust is permitted to adhere about said through holes due to electrostatic suction of the discharge electrodes since said through holes are exposed to the outside, whereby the discharge action is unstabilized and leaking electric current flowing between discharge electrodes are liable to impair the picture.

Moreover, the use of discharge elements as discrete parts and the provision of through holes on the substrate permit an unpleasant spark noise to be generated at each discharge.

The invention relates to a cathode-ray tube socket substrate comprising an insulation substrate provided with terminal electrodes enabling to mount a cathode-ray tube socket in the state of electric connection, the substrate being provided with discharge electrodes disposed so as to be opposed to said terminal electrodes and earth electrode, discharge gaps being formed by providing recesses on the substrate between the discharge electrodes, respectively.

The invention has for a first object to provide a cathode-ray tube socket substrate which can be miniaturized as a whole.

The invention has for a second object to provide a cathode-ray tube socket substrate capable of precluding dust from adhering to discharge gaps and stabilizing the discharge action.

The invention has for a third object to provide a cathode-ray tube socket capable of reducing unpleasant spark noises even when discharge is generated.

These and other objects are accompanied by improvements, combinations and arrangements of the respective parts comprising the invention, preferred embodiments of which are shown by way of examples in the accompanying drawings and herein described in detail.

Figure 1:
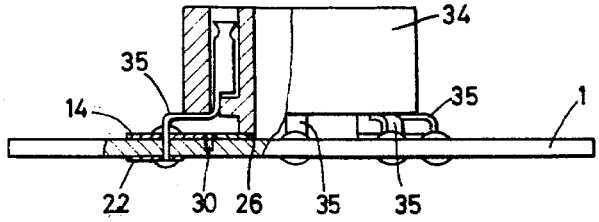
FIG. 1 is an elevational view, broken away in part, showing a first embodiment of the cathode-ray tube socket substrate according to the invention.
Figure 2:
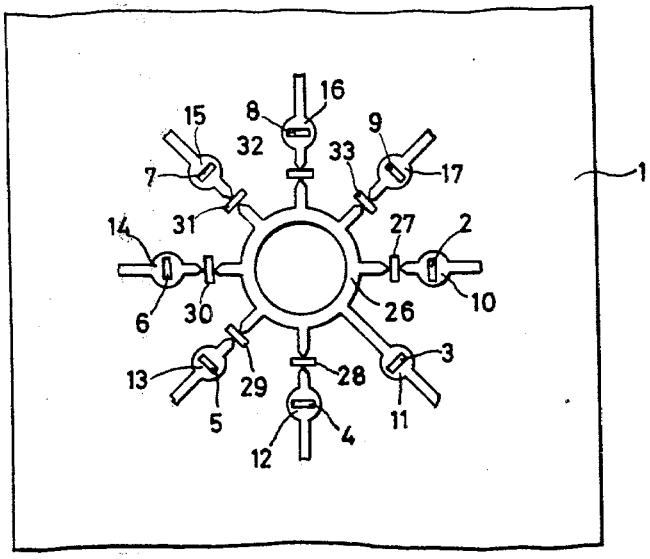
FIG. 2 is a plan view of an insulation substrate prior to connection thereto of the socket of FIG. 1.
Figure 3:
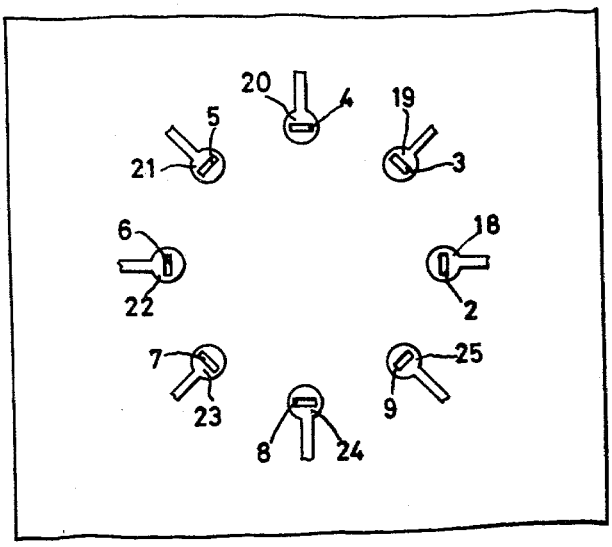
FIG. 3 is a bottom view of the insulation substrate.

In FIGS. 1 to 3 showing the first embodiment of the invention, the numeral 1 designates an insulation substrate consisting of ceramics such as alumina, steatite, forsterite, etc., 2,3,4,5,6,7,8 and 9 designating through holes accurately disposed in predetermined positions on the substrate 1 for receiving pin terminals of the cathode-ray tube socket which will be described in detail hereinafter.

The numerals 10,11,12,13,14,15,16 and 17 designate terminal electrodes provided on the surface of the substrate 1 so as to encircle the aforesaid through holes respecrively, 18,19,20,21,22,23,24 and 25 designating terminal electrodes provided on the reverse side of the substrate 1 so as to encircle said through holes respectively. The through hole 3 is for receiving the earth pin terminal of the cathode-ray tube, the terminal electrode 11 on the surface of the substrate being connected to annular earth electrode 26 provided in the center of the surface of the substrate encircled by through holes 2 to 9. The numerals 27,28,29,30,31,32 and 33 designate slit-shaped recesses forming discharge gaps provided on the substrate between the terminal electrodes thereon, 10,12–17, and the earth electrode 26. As shown in FIG. 2, on both sides of each of the recesses there are provided discharge electrodes extended from the respective electrodes so as to be opposed to each other with said recess interposed therebetween. Though not shown in the drawings, on the insulation substrate 1 there are disposed required cathode-ray tube peripheral circuits, such as color output circuit, etc., in case of a color television receiving set, and image output circuit, etc., in case of a black-and-white television receiving set, comprising transistors, resistors, condensers and the like, required output being connected to the respective electrode of the through hole for receiving the pin terminals of the cathode-ray tube socket.

The numeral 34 designates a cathode-ray tube socket mounted on the surface of the substrate 1, pin terminals 35 extended to the reverse side of the socket body being fitted into predetermined through holes 2–9 of the substrate 1, said pin terminals being securely soldered to the electrodes around the through holes respectively as shown in FIG. 1. The locational relationship between the cathode-ray tube socket 34 mounted on the substrate 1 and the recesses 27–33 thereof is such that part of the cathode-ray tube socket 34 is adapted to be located above the recesses so as to cover said recesses respectively as shown in FIG. 1.

Thus, in case of the embodiment shown in FIG. 1, the cathode-ray tube socket 34 serves also as a sheating member for the prevention of the adhesion of dust to the recesses 27–33.

Now the second embodiment shown in FIGS. 4 and 5 will be described in detail.

The second embodiment has for an object to further improve the dustproof effect of the cathode-ray tube socket covering the recesses. The same parts as in the first embodiment are indicated by the same reference numerals, the descriptions related thereto being omitted. According to the second embodiment, the cathode-ray tube socket 34 is provided on its bottom face with two projecting annular walls 36,37 with a predetermined spacing interposed therebetween, said spacing formed between the projecting walls 36, 37 being partitioned into compartments 46,47,48,49,50,51,52,53 by a plurality of projecting walls 38,39,40,41,42,43,44,45 radially provided across said spacing.

In the first embodiment shown in FIG. 1, the recesses provided on the substrate, though covered by the cathode-ray tube socket, are open in the peripheral direction of the lower part of the socket, while in the second embodiment each of the recesses is covered by each compartment formed on the bottom face of the socket. Since the recesses provided on the substrate are not open directly to the outside, adhesion of dust about the recesses is prevented with greater reliability. If the bottom face of each projecting wall is fixed to the substrate by means of an adhesive or if each of the recesses is formed on the substrate so as to coincide with the bottom part of each projecting wall so that the bottom part of the projecting wall fits into the recesses respectively, each compartment is hermetically sealed with greater reliability.

Figure 7:
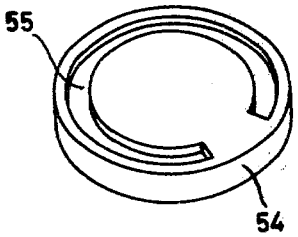
FIG. 7 is a perspective view showing a dustproof cover for use with the third embodiment.
Figure 6:
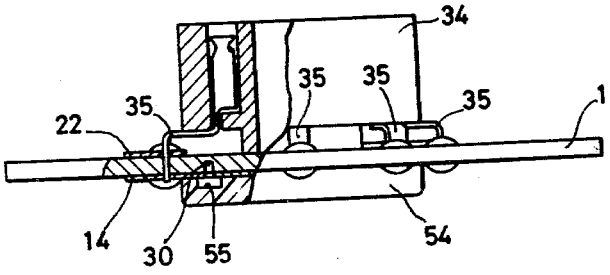
FIG. 6 is an elevation view, broken away in part, showing a third embodiment of the cathode-ray tube socket substrate according to the invention.

The third embodiment shown in FIGS. 6 and 7 will be described in detail hereinunder.

In the third embodiment, each electrode, discharge electrodes and slit-shaped recesses are provided on the reverse side of the insulation substrate, said recess being covered by a dustproof cover. The same parts as in the first embodiment shown in FIGS. 1 to 3 are indicated by the same reference numerals, the descriptions related thereto being omitted. Though the obverse and reverse faces of the insulation substrate are not illustrated, the arrangement of electrodes and the recesses is precisely opposite to that of the first embodiment, the disposition of the terminal electrodes and through holes on the surface being substantially same as that of FIG. 3, while the disposition of the terminal electrodes, earth electrode, recesses and discharge electrodes are substantially same as that of FIG. 2.

The dustproof cover 54 mounted on the reverse side of the insulation substrate 1 is formed so as to cover the recesses 27–33 forming the discharge gaps. As shown in FIG. 7, a hollow 55 is formed in the part corresponding to the discharge electrodes provided at both sides of the recesses 27–33 on the reverse side of the substrate 1. Though not shown, the dustproof cover is mounted on the substrate 1 by appropriate means, for example, by clinching a rivet inserted through said dustproof cover 54 and the cathode-ray tube socket 34 or securing the dustproof cover directly to the substrate by means of an adhesive.

While particular embodiments of the invention have been illustrated and described herein, they are not intended to limit the invention and changes and modifications may be made within the scope of the invention. For example, the terminal electrodes around the through holes 2–9 for receiving the pin terminals of the cathode-ray tube socket, if provided on both faces of the substrate as in the embodiments, enable to form the required circuits on both faces of the substrate thereby enabling to miniaturize the cathode-ray tube socket substrate. However, it is not always necessary that the required circuits be formed on both faces of the substrate, the provision of such terminal electrode on one side of the substrate only sufficing. Furthermore, the location of the earth electrode 26 on the substrate is not necessarily restricted to the part encircled by the through holes 2–9 but can be determined in any other adequate part. Moreover, its configuration is not necessarily limited to an annular shape. Still further, in case where the voltage impressed on the focus electrode of the cathode-ray tube is high such as in a console type television receiving set, the predetermined facial distance is not obtainable simply by forming the discharge gaps by means of the recesses. It may be so arranged, therefore, that the discharge gaps of the low voltage part are formed by recesses, while the conventional discharge means are employed relative to the focus electrode.

Figure 4:
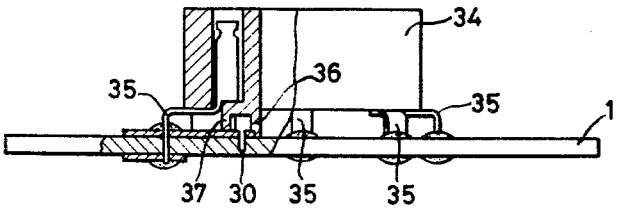
FIG. 4 is an elevational view, broken away in part, showing a second embodiment of the cathode-ray tube socket substrate according to the invention.

When the recesses provided on the substrate are covered by the compartments partitioned by the projecting walls on the bottom face of the socket as in the second embodiment shown in FIG. 4, it is not always necessary that each of the recesses be covered by each of the compartments. The whole of the recesses may be covered by a spacing formed by the annular projecting walls 36,37 only.

Figure 5:
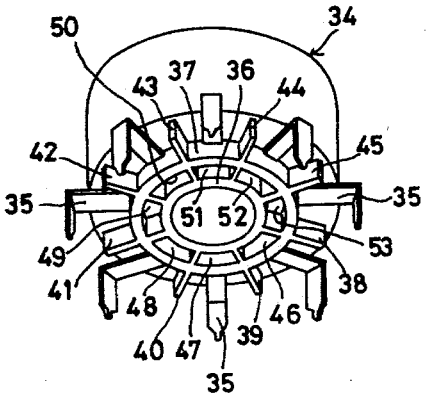
FIG. 5 is a perspective view of the cathode-ray tube socket shown in the second embodiment as seen from the bottom side.

Furthermore, compartments substantially same as those formed by each projecting wall of FIG. 5 may be formed by forming recesses on the bottom face of the socket.

The insulation substrate 1 of the first to third embodiments and the dustproof cover 54 of the third embodiment may be provided with a through hole of the same diameter coaxially as is usually provided in the center of the cathode-ray tube socket 34, if necessary. The hollow 55 formed on the dustproof cover 54, though a hollow in the shape of a single slender groove is shown in FIG. 7, may be an independent hollow for each of the discharge electrodes. Still further, the dustproof cover 54 can be formed in a plurality of divisions. As described hereinbefore, the cathode-ray tube socket substrate according to the invention comprises discharge gaps formed by providing recesses on the substrate, the recesses being covered by a sheathing member, thereby enabling the discharge means to be integrally composed with high compactness and accordingly the cathode-ray tube socket substrate to be miniaturized. Moreover, since the discharge gaps are not extended through the substrate, dust is precluded from adhering to the discharge gaps thereby enabling to highly stabilize the discharge action and reduce the unpleasant spark noises due to discharge.

What is claimed is:

1. A cathode-ray tube socket substrate comprising an insulation substrate, a plurality of through holes provided in predetermined locations on the insulation substrate, a plurality of terminal electrodes provided at least on one face of the insulation substrate so as to encircle the through holes, a cathode-ray tube socket mounted on the insulation substrate with its terminals extending beyond the reverse side of the socket body being inserted into the respective through holes and securely connected to the respective electrodes around said through holes, cathode-ray tube peripheral circuits composed on the insulation substrate and connected to the required pin terminals of the cathode-ray tube socket respectively, earth electrode mounted on the surface of the insulation substrate where the terminal electrodes are provided, a plurality of discharge electrodes provided so as to oppose the earth electrode and required terminal electrodes among those encircling the through holes, a plurality of recesses provided between the opposed discharge electrodes on the substrate, and a sheathing member mounted on the insulation substrate so as to cover the recesses.

2. A cathode-ray tube socket substrate according to claim 1 wherein the terminal electrodes encircling the through holes, the earth electrode, the discharge electrodes and the recesses are provided on the surface of the insulation substrate, the cathode-ray tube socket serving also as a sheathing member for covering the recesses.

3. A cathode-ray tube socket substrate according to claim 1 wherein the terminal electrodes encircling the through holes, the earth electrode, the discharge electrodes and the recesses are provided on the reverse side of the insulation substrate, the sheathing member for covering the recesses being formed by a dustproof cover mounted on the reverse side of the insulation substrate.

4. A cathode-ray tube socket substrate according to claim 1 wherein a plurality of through holes are circularly disposed about a predetermined axis, the earth electrode, the discharge electrodes and the recesses being provided on the part defined by said through holes.

5. A cathode-ray tube socket substrate according to claim 1 wherein the earth electrode is annularly formed.

* * * * *